US007350556B2

(12) United States Patent
Pernicano

(10) Patent No.: US 7,350,556 B2
(45) Date of Patent: Apr. 1, 2008

(54) ROLL-UP POLE FOR TENT PANEL

(76) Inventor: Vincent Pernicano, 2833 Railroad St., P.O. Box 103, Boyne Falls, MI (US) 49713

( * ) Notice: Subject to any disclaimer, the term of this patent is extended or adjusted under 35 U.S.C. 154(b) by 365 days.

(21) Appl. No.: 11/105,985

(22) Filed: Apr. 14, 2005

(65) Prior Publication Data

US 2005/0257902 A1 Nov. 24, 2005

Related U.S. Application Data

(60) Provisional application No. 60/562,063, filed on Apr. 14, 2004.

(51) Int. Cl.
*A47G 5/02* (2006.01)

(52) U.S. Cl. ..... 160/243; 135/120.1

(58) Field of Classification Search ..... 160/243, 160/242, 244, DIG. 15, 261, 399, 401, 402, 160/263; 135/117, 120.1; 242/586.4, 586.2
See application file for complete search history.

(56) References Cited

U.S. PATENT DOCUMENTS

| | | | | | |
|---|---|---|---|---|---|
| 827,000 | A | * | 7/1906 | Dinsmore | 160/384 |
| 1,393,420 | A | * | 10/1921 | Ash et al. | 242/586.4 |
| 1,466,275 | A | * | 8/1923 | Denison | 242/586.4 |
| 1,795,261 | A | * | 3/1931 | Murphy | 160/238 |
| 2,255,837 | A | | 9/1941 | Volk | |
| 2,568,048 | A | | 9/1951 | Arnold | |
| 2,660,186 | A | | 11/1953 | Marshall et al. | |
| 2,788,791 | A | | 4/1957 | Pospisil et al. | |
| 2,886,047 | A | | 5/1959 | Healy | |
| 3,207,455 | A | * | 9/1965 | Thrasher | 242/586.2 |
| 3,304,022 | A | * | 2/1967 | Caffe | 242/586.2 |
| 3,324,869 | A | | 6/1967 | Duda | |
| 3,327,724 | A | | 6/1967 | Nielsen | |
| 3,329,195 | A | * | 7/1967 | Kochanowski | 160/24 |
| 3,426,775 | A | | 2/1969 | Jonckheere et al. | |
| 3,612,145 | A | | 10/1971 | Darula | |
| 4,020,888 | A | | 5/1977 | Upton et al. | |
| 4,030,780 | A | | 6/1977 | Petretti | |
| 4,117,876 | A | | 10/1978 | Bennett | |
| 4,188,964 | A | | 2/1980 | Greer | |
| 4,231,289 | A | * | 11/1980 | Domicent | 454/52 |
| RE30,664 | E | | 7/1981 | Upton et al. | |
| 4,691,957 | A | | 9/1987 | Ellingson | |
| 5,558,145 | A | | 9/1996 | Baka | |
| 5,819,474 | A | * | 10/1998 | Strom | 52/4 |
| 5,823,067 | A | | 10/1998 | Clarys et al. | |
| 5,881,792 | A | * | 3/1999 | Cheng | 160/263 |
| 5,944,085 | A | | 8/1999 | Malott | |
| 5,967,692 | A | | 10/1999 | Tabellini | |
| 6,021,834 | A | | 2/2000 | Malott | |
| 6,860,312 | B2 | | 3/2005 | Judkins | |

* cited by examiner

*Primary Examiner*—Blair M. Johnson
(74) *Attorney, Agent, or Firm*—Dickinson Wright PLLC

(57) ABSTRACT

A role-up pole assembly includes telescoping tubular members (20, 26) that are extended to a predetermined position where the open ends (22, 28) thereof are aligned with the edges of a canvas panel (32). A clamp mechanism (38) is retained in each open end (22, 28) by a bungee cord (48) whereby the clamp mechanism (38) may be pulled out of the associated open end (22, 28) to clamp the edge of the panel (32) to the open end (22, 28) of the tubular member (20, 26). The tubular members (20, 26) are be locked so that the pole may be rotated to coil the panel (32) about the pole.

17 Claims, 4 Drawing Sheets

ROLL-UP POLE FOR TENT PANEL

CROSS REFERENCE TO RELATED APPLICATION

This application claims the benefit of provisional application Ser. No. 60/562,063 filed Apr. 14, 2004.

BACKGROUND OF THE INVENTION

1. Field of the Invention

The invention is a roll-up pole assembly for rolling-up a canvas panel of the type used as a side of a tent 2. Description of the Prior Art It is notoriously old to wrap, coil or roll a flexible sheet about a pole or insert. One common assembly is that of a retractable blind in the widow of a residence. There are numerous such winding assemblies known for coiling flexible panels like canvas awnings and sides of tents. Such prior art assemblies are illustrated in U.S. Pat. Nos. 3,923,074 and 4,033,397 to McKee; 4,077,419 to Lux; 5,033,132 to Greenblatt; 5,044,416 to Murray and 5,601,129 to Colson et al.

The prior art assemblies are rather permanent to each installation, i.e., they are not portable or adaptable to more than one flexible sheet to be rolled up.

SUMMARY OF THE INVENTION AND ADVANTAGES

The invention provides for rolling up a flexible panel having edges about a pole having a first open end presenting a first circular rim and a second open end presenting a second circular rim by clamping an edge of the panel to the first rim at the first open end with a first clamp mechanism, clamping an opposite edge of the panel to the second rim at the second open end with second clamp mechanism, and rotating the pole to coil the panel about the pole.

Accordingly, the subject invention is very simple and portable for use with numerous panels as the pole may be unclamped and removed from a coiled panel.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
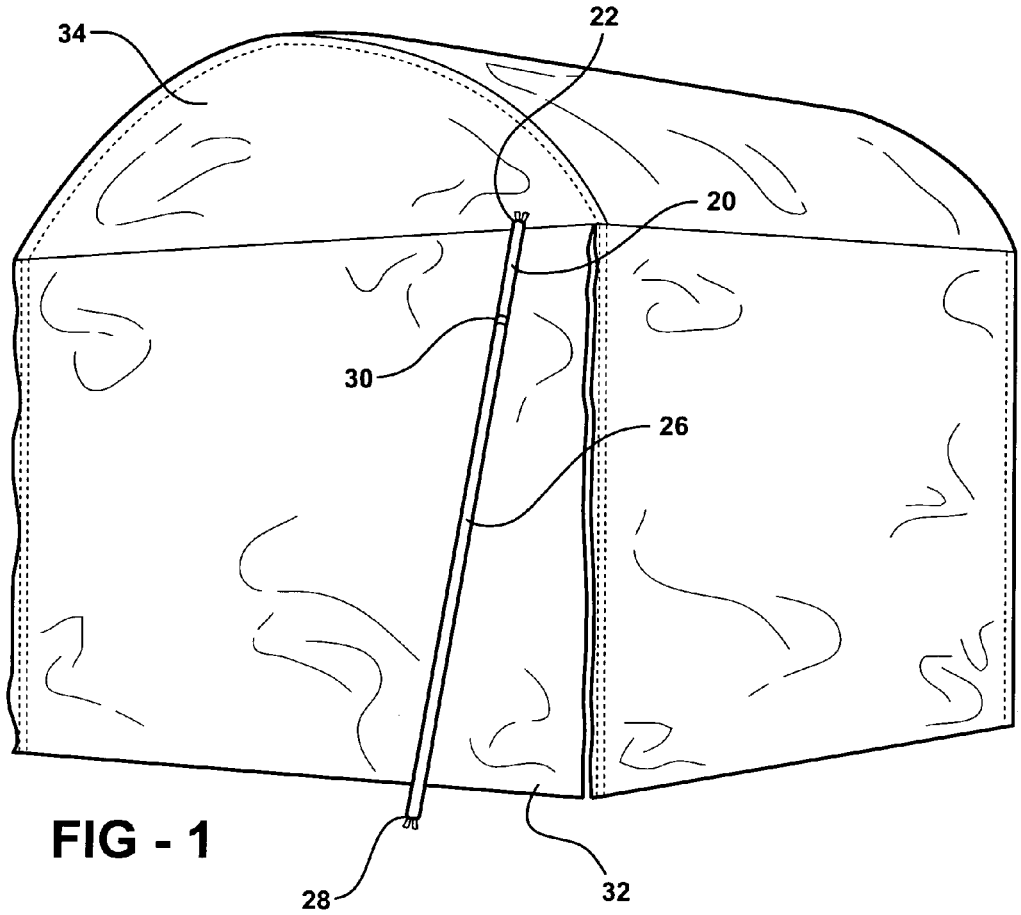
FIG. 1 is a perspective view of a tent having a panel to be coiled about the pole of the subject invention.
Figure 2:
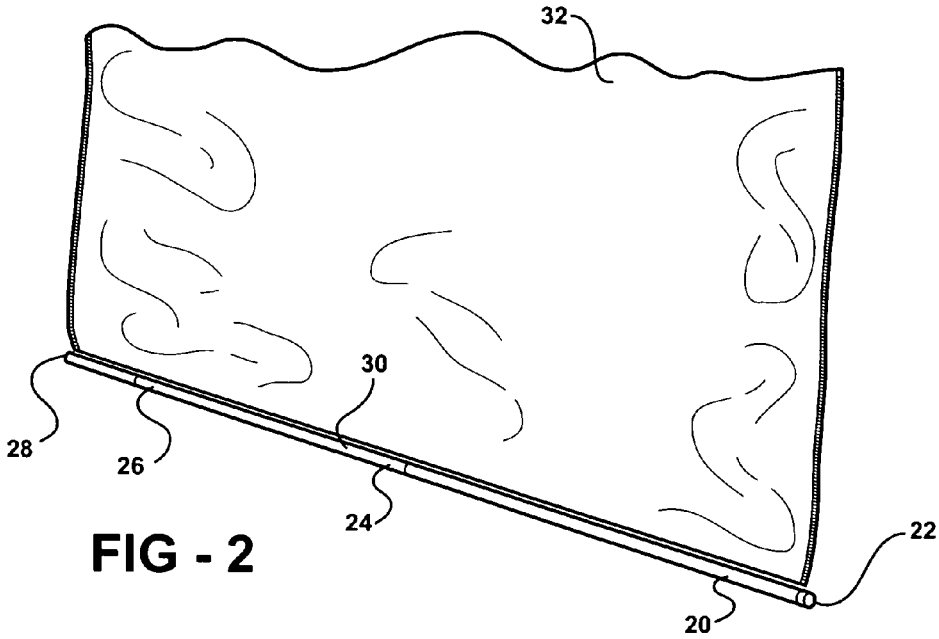
FIG. 2 is perspective view of the pole of the subject invention in the extended position at the bottom of the panel to be coiled thereabout.
Figure 3:
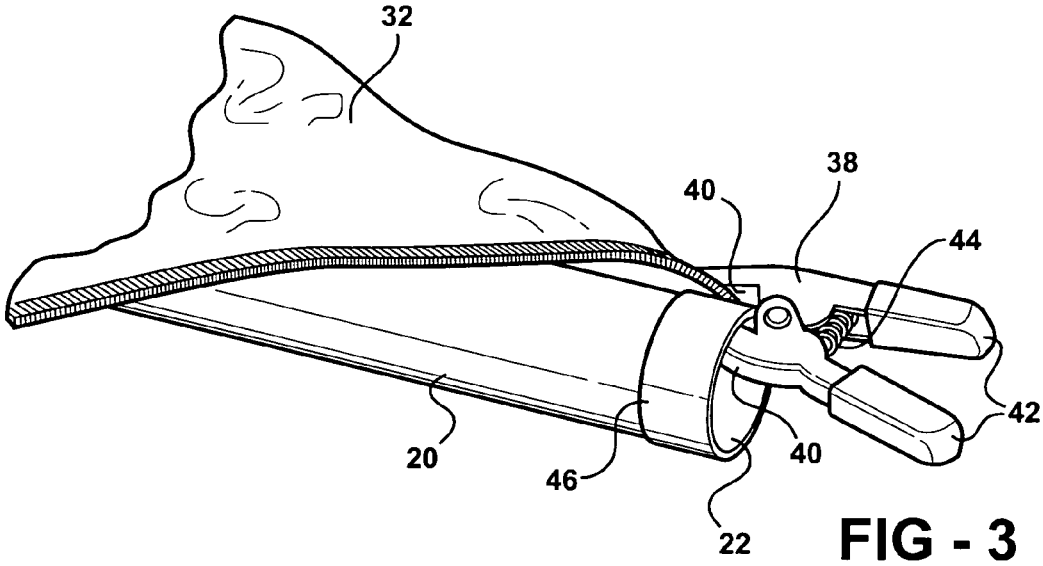
FIG. 3 is a perspective view showing a clamp mechanism clamping an edge of the panel to an open end of the subject invention.
Figure 4:
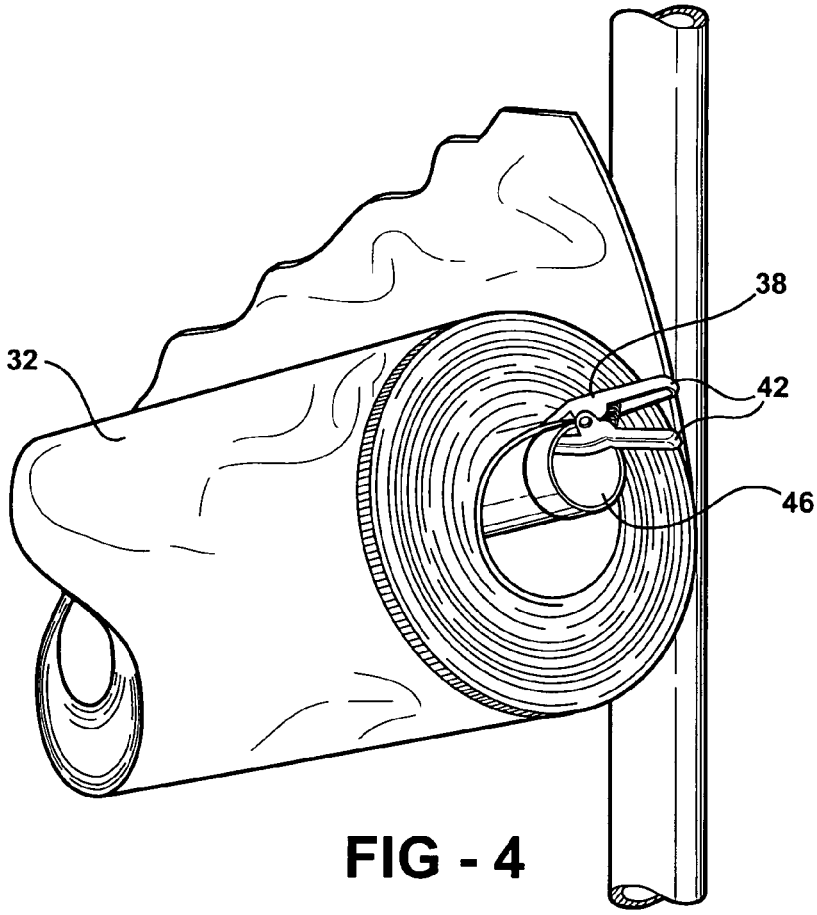
FIG. 4 is a perspective view like FIG. 3 but showing the panel coiled about the subject invention.
Figure 5:
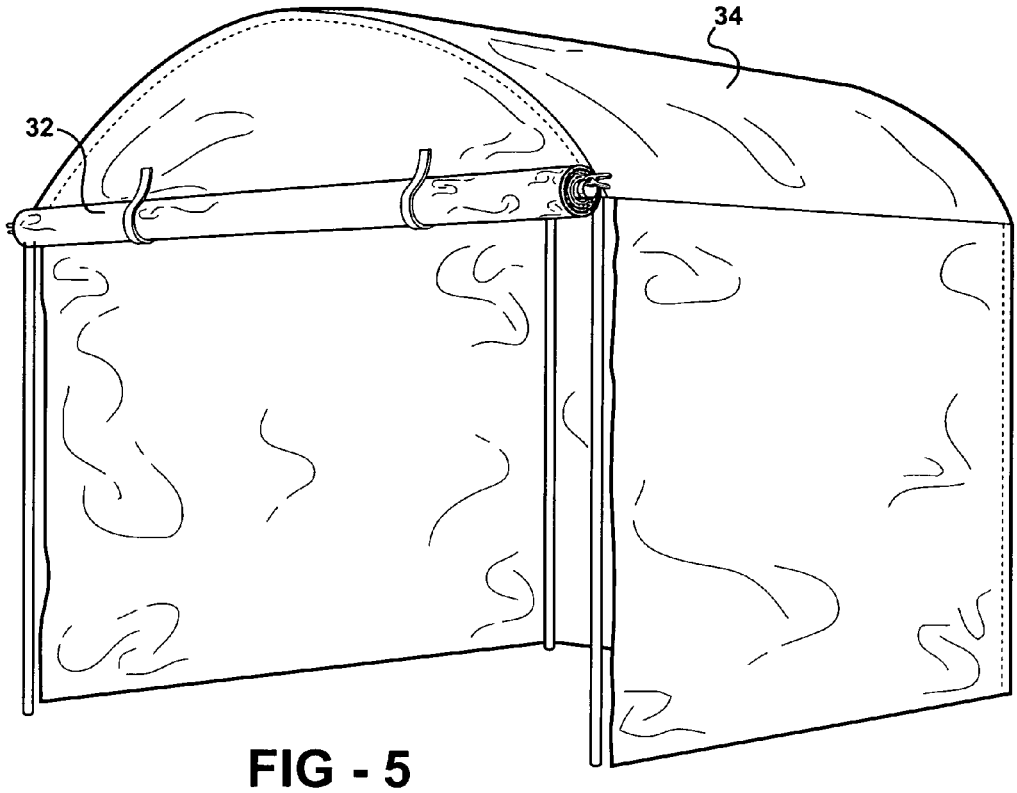
FIG. 5 is a perspective view of the entire tent with the panel in the rolled-up position.

A role-up pole assembly is shown generally in the drawings and includes a pole defined by an anodized aluminum first tubular member 20, having the first open end 22 and a first telescoping end 24, and an anodized aluminum second tubular member 26, having the second open end 28 and a second telescoping end 30. The second telescoping end 30 of the second tubular member 26 is in telescoping relationship with the first telescoping end 24 of the first tubular member 20. The smaller first tubular member 20 being approximately five feet, six inches long with a seven eights inch outside diameter to telescope snugly inside the second tubular member 26 of the same length but a slightly larger inch outside diameter. When the pole is in the collapsed position with the smaller first tubular member 20 telescoped into the inside of the larger second tubular member 26, the total length is approximately five feet ten and one half inches with about four and one half inches of the smaller first tubular member 20 protruding from the larger second tubular member 26. When the pole is extended, the first tubular member 20 is pulled out of the larger second tubular member 26 to match or equal the width of the panel 32 being rolled up, as shown in FIG. 2. With the tubular members 20, 26 having the lengths noted above, the pole will expand to a maximum of ten feet ten and one half inches, it being appreciated that the lengths may vary.

The pole may be used by one person to roll up a canvas panel 32 of a tent 34, or the like. The pole is extended so that the open ends 22, 28 are at the edges of the panel 32, as illustrated in FIG. 2.

Figure 7:
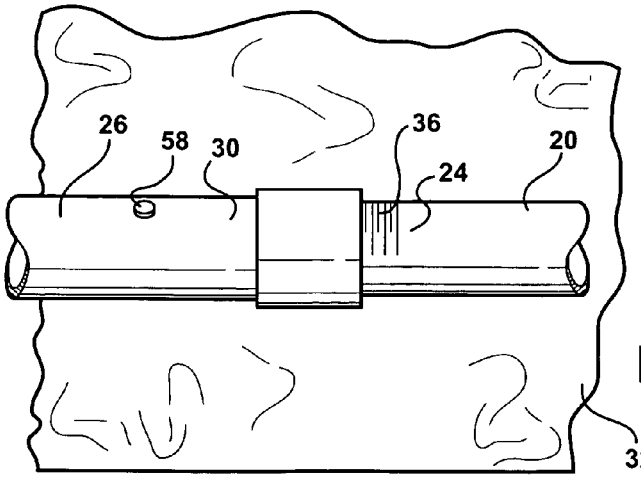
FIG. 7 is a perspective view of the two telescoped tubular members in an extended position with indicia indicating the predetermined extended position to match the width of the panel to be coiled thereabout.

As shown in FIG. 7, the pole includes including indicia 36 or a mark on the smaller first tubular member 20 for indicating the extended position for positioning the open ends 22, 28 at the edges of a predetermined panel 32. The inside or smaller first tubular member 20 can be marked at the junction of the two tubes when expanded to match the width of the canvas panel 32 and the mark can thereafter be used as a guide each time it is used. At the center of the pole, the larger second tubular member 26 has a lip around it's inside circumference and the smaller first tubular member 20 has a radial interference with the lip so that the tubular members 20, 26 cannot be accidentally pulled apart.

Figure 8:
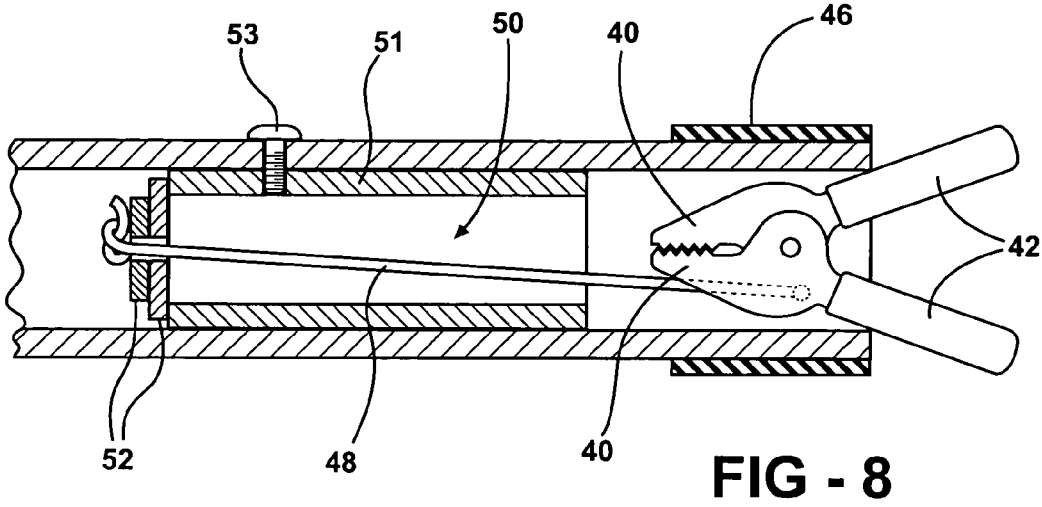
FIG. 8 is a perspective view of a retaining device for storing the a clamp mechanism in an open end as illustrated in FIG. 6 while allowing the clamp mechanism to move to the clamping position illustrated in FIG. 4.

The first open end 22 presents a first circular rim and the second open end 28 presents a second circular rim. A first clamp mechanism 38 (shown generally in FIG. 8) is included for clamping an edge of a panel 32 of flexible canvas material to the first rim at the first open end 22 in a first clamping position. Likewise, a second clamp mechanism 38 is included for clamping the opposite edge of the panel 32 to the second rim at the second open end 28 in a second clamping position. Accordingly, the panel 32 may be clamped to the pole and coiled or rolled thereabout by manually rotating the pole.

Each of the first and second clamp mechanisms 38 comprises a pair of jaws 40, a pair of gripping handles 42 for moving the jaws 40, and a biasing device 44 for urging the jaws 40 into a clamping relationship with one another whereby the jaws 40 may be manually moved apart and released for clamping engagement with the associated the rim. The clamp mechanisms 38 are well known hardware clamps. Each jaw 40 is integrally formed with a handle 42 to define one homogeneous piece pivotally connected to the other one-piece handle 42 and jaw 40 by a rivet, pin, or the like. The handles 42 are covered with a plastic cover and the jaws 40 may be roughened to enhance gripping. The jaws 40 are biased together by a biasing device 44 comprising a coil spring interacting between the handles 42. The canvas clamp mechanisms 38 consist of small spring loaded clamps which hold the panel 32 tight to the open ends 22, 28 of the extended telescoping tubular members 20, 26. Each clamp mechanism 38 holds or clamps the canvas panel 32 by compressing the corners at the bottom edge of the panel 32 between the inside of the outside of the open ends 22, 28 of the respective tubular members 20, 26. One jaw 40 of the clamp mechanism 38 is disposed inside the associated open end 22, 28 and the other jaw 40 grips the panel 32 firmly against the outside of the open end 22, 28. The jaws 40 of each pair are curved to enhance clamping to the open ends 22, 28. More specifically, about one quarter of an inch of the outside canvas griping jaw 40 of the clamp mechanism 38 is bent at a right angle and is shaped into a slight concave curve so that it fits snugly against the curvature of the outside of the open end 22, 28 of the tubular member 20, 26 to thereby achieve a better grip on the panel 32. The jaw 40 that goes inside the open end 22, 28 is also bent at a right angle and is shaped into a convex curve to better grip the inside of the open end 22, 28 of the tubular member 20, 26.

Figure 6:
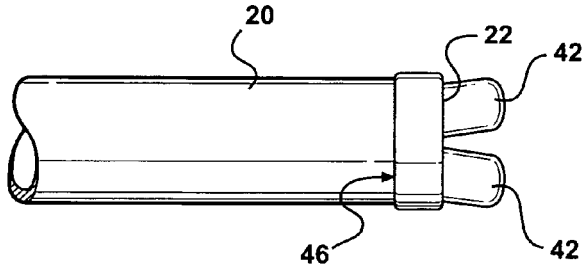
FIG. 6 is a perspective view of a clamp mechanism disposed in an open end of the subject invention.

In addition and very importantly, the handles 42 are separated by a space greater than the associated the open end 22, 28 to prevent each clamp mechanism 38 from entering the associated the open end 22, 28 of the respective tubular members 20, 26, as shown in FIG. 6. In other words, in the at rest or stored state, with the jaws 40 held together by the biasing device 44 or spring, the handles 42 diverge to a separation greater than the diameter of the open ends 22, 28 of the respective tubular members 20, 26 to prevent the clamp mechanisms 38 from entering the respective open ends 22, 28. This is important to retain the clamp mechanisms 38 in the open ends 22, 28 of the tubular members 20, 26 when not in use and for removing the pole form a coiled panel.

This retained position of the clamp mechanism 38 in the respective open ends 22, 28 may be by friction. A heat shrink plastic sleeve 46 is disposed on the inside and the outside of each of the open ends 22, 28 of the aluminum tubular members 20, 26 to improve the frictional grip between the handles 42 of the clamp mechanisms 38 and the panel 32. Instead of or in addition to the friction, a first retaining device 50 (shown in FIG. 8) for storing the first clamp mechanism 38 in the first open end 22 while allowing the first clamp mechanism 38 to move to the first clamping position. For the second clamp mechanism 38, a second retaining device 50 is included for storing the second clamp mechanism 38 in the second open end 28 and for allowing the second clamp mechanism 38 to move to the second clamping position.

Each of the retaining devices comprises 50 spring-like actuator to urge the associated of the clamp mechanisms 38 into respective of the open ends 22, 28. Although springs and various biasing means may be utilized, a bungee cord 48 has proven very satisfactory. A six inch long and one eight inch diameter bungee cord 48 passes through a small hole near the front of the jaw 40 that will grip the tubular member 20, 26 from the inside and passes under the clamp spring and is secured with a knot or a bungee crimp. The other of the bungee cord 48 that comes out of the jaw 40 of the clamp mechanism 38 passes through a three inch long piece of one eight inch thick with either a three quarter or seven eights inch diameter vinyl tubing. For the purpose of the illustrated embodiment, both diameters of the vinyl tubing are used because the three quarter inch vinyl tubing fits inside the seven eights inch diameter of the smaller first tubular member 20 and the seven eights inch diameter vinyl tubing fits inside of the one inch diameter of the larger second tubular member 26. The bungee cord 48 then passes through a seven eights inch diameter or a three quarter inch diameter aluminum washer 52 and then through a three eights inch anchor washer 52 and is pulled taught but not stretched and is then secured against pulling through the small anchor washer 52 with a knot or bungee crimp clip. The inner of the bungee cord 48 is anchored in the respective tubular members 20, 26 by a tube 51 and pin 53 passing diametrically into the respective tubular member 20, 26 and into the tube 51. The second smaller washer 52 allows the bungee cord 48 to swivel three hundred and sixty degrees relative to the non-rotatable large washer 52 held against the end of a tube 51 so the clamp mechanism 38 can rotate around each tubular member 20, 26 without causing the bungee cord 48 to twist up on itself, as it would if held stationary. The ability to rotate three hundred sixty degrees also allows the clamp mechanisms 38 to be lined up with one another when attaching the panel 32 to the open ends 22, 28. The sub-assembly consisting of the clamp mechanism 38, bungee cord 48, and vinyl sleeve 46 the tube 51, the pin 53 and washers 52, is placed inside each of the open ends 22, 28 of the respective tubular members 20, 26. Because the vinyl sleeve 46 has an inherent curvature it fits snugly inside the open end 22, 28 and stays in place until secured. A small hole is drilled through the tubular member 20, 26 and into the vinyl sleeve 46 and the sub-assembly is securely set with small aluminum screw or rivet.

Figure 9:
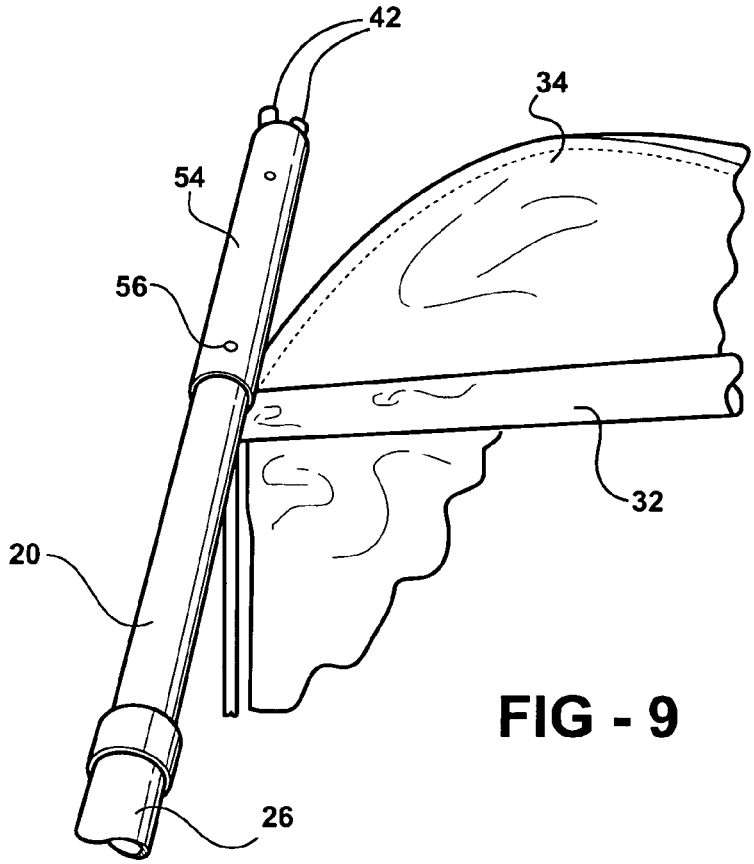
FIG. 9 is a perspective view of an end piece of a larger diameter secured to the distal end of the smaller first tubular member.

The use of the largest possible clamp mechanism 38 is determined by the inside diameter of the open ends 22, 28 and the larger the clamp mechanism 38, the larger the clamping force. As alluded to above, the first tubular member 20 is smaller in diameter than the second tubular member 26 whereby the first tubular member 20 telescopes into the second tubular member 26 so that the larger inside diameter of the second tubular member 26 will accept a larger clamp mechanism 38. In order for the first tubular member 20 to accept the larger clamp mechanism 38, the first tubular member 20 may include an end piece 54 of a larger diameter, e.g., the same diameter as the second tubular member 26. As illustrated in FIG. 9, the end piece 54 may be secured in place by a set screw 56.

The extensible pole includes a lock for locking the tubular members 20, 26 against telescoping movement relative to one another in at least one extended position, but usually to any one of various extended positions. The lock can either be the well known twist locking cam or button 58 to engage a hole. The cam allows more flexible variation in the width of the panel 32 and has no protruding button 58 to catch on the panel 32 while removing pole after the panel 32 is rolled up. The cam works by holding the large second tubular member 26 firmly and twisting the small first tubular member 20 in either direction. Once unlocked the tubular members 20, 26 are un-telescoped or pulled apart to the predetermined width of the panel 32 and then rotated relative to one another to again prevent relative rotation in the extended position.

As will be appreciated from the foregoing, the invention also provides a method of rolling up a flexible panel 32 characterized by the steps of clamping an edge of a panel 32 of flexible material to the first rim at the first open end 22, clamping an opposite edge of the panel 32 to the second rim at the second open end 28 in a second clamping position, and rotating the pole to coil the panel 32 about the pole.

Further defining steps of the method include storing a first clamp mechanism 38 in the first open end 22, and moving the first clamp mechanism 38 to a first clamping position for clamping an edge of a panel 32 of flexible material to the first rim. And, likewise included, are the steps of storing a second clamp mechanism 38 in the second open end 28, and moving the second clamp mechanism 38 to a second clamping position for clamping the opposite edge of the panel 32 to the second rim.

Additional steps include urging the associated of the clamp mechanisms 38 into respective of the open ends 22, 28 while allowing the clamp mechanisms 38 to move to the clamping positions and telescoping a first tubular member 20 having the first open end 22 into a second tubular member 26 having the second open end 28 and extending the tubular members 20, 26 to an extended position for clamping the opposite edges of the panel 32.

Once the panel 32 has been rolled up, it may be wrapped with a holding strap, or the like, and the clamp mechanism 38 can be removed and the pole taken out of the coiled panel 32. The holding strap can just be released and the coiled panel 32 will unwind of its own weight.

Obviously, many modifications and variations of the present invention are possible in light of the above teachings. The invention may be practiced otherwise than as specifically described within the scope of the appended claims, wherein that which is prior art is antecedent to the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the incentive novelty exercises its utility. In addition, the reference numerals in the claims are merely for convenience and are not to be read in any way as limiting.

What is claimed is:

1. A roll-up pole assembly comprising:

a pole having a cylindrical exterior suface and having a first open end (22) presenting a first circular rim and a second open end (28) presenting a second circular rim and characterized by a first clamp mechanism (38) for clamping an edge of a panel (32) of flexible material to said first rim at said first open end (22) in a first clamping position, a second clamp mechanism (38) for clamping an opposite edge of the panel (32) to said second rim at said second open end (28) in a second clamping position whereby the panel (32) may be clamped to the pole and coiled thereabout by rotating the pole, and a first retaining device (50) for storing said first clamp mechanism (38) in said first open end (22) such that said first clamping mechanism does not engage said exterior surface of said pole and for allowing said first clamp mechanism (38) to move to said first clamping position.

2. An assembly as set forth in claim 1 including a second retaining device (50) for storing said second clamp mechanism (38) in said second open end (28) and for allowing said second clamp mechanism (38) to move to said second clamping position.

3. An assembly as set forth in claim 2 wherein each of said first and second clamp mechanisms (38) comprises a pair of jaws (40), gripping handles (42) for moving said jaws (40), and a biasing device (44) for urging said jaws (40) into a clamping relationship with one another whereby said jaws (40) may be manually moved apart and released for clamping engagement with the associated said rim.

4. An assembly as set forth in claim 3 wherein said handles (42) are separated by a space greater than the associated said open end (22, 28) to prevent said clamp mechanism (38) from entering the associated said open end (22, 28).

5. An assembly as set forth in claim 4 wherein each of said retaining devices (50) comprises spring-like device (44, 50) to urge the associated of said clamp mechanisms (38) into respective of said open ends (22, 28).

6. An assembly as set forth in claim 5 wherein each pair of said jaws (40) are curved to enhance clamping to said open ends (22, 28).

7. An assembly as set forth in claim 6 wherein said pole includes a first tubular member (20) having said first open end (22) and a first telescoping end (24), a second tubular member (26) having said second open end (28) and a second telescoping end (30) in telescoping relationship with said first telescoping end (24) of said first tubular member (20), and a lock for locking said tubular members (20, 26) in at least one extended position.

8. An assembly as set forth in claim 7 including indicia (36) on said first tubular member (20) for indicating the extended position for positioning said open ends (22, 28) at the edges of a predetermined panel (32).

9. An assembly as set forth in claim 1 wherein said pole includes a first tubular member (20) having said first open end (22) and a first telescoping end (24), a second tubular member (26) having said second open end (28) and a second telescoping end (30) in telescoping relationship with said first telescoping end (24) of said first tubular member (20).

10. An assembly as set forth in claim 9 including a lock for locking said tubular members (20, 26) in at least one extended position.

11. An assembly as set forth in claim 9 wherein said first tubular member (20) is smaller than said second tubular member (26) whereby said first tubular member (20) telescopes into said second tubular member (26), said first tubular member (20) includes an end piece (54) of a larger diameter.

12. An assembly as set forth in claim 1 wherein each of said first and second clamp mechanisms (38) comprises a pair of jaws (40), gripping handles (42) for moving said jaws (40), and a biasing device (44) for urging said jaws (40) into a clamping relationship with one another whereby said jaws (40) may be manually moved apart and released for clamping engagement with the associated said rim.

13. An assembly as set forth in claim 12 wherein said handles (42) are separated by a space greater than the associated said open end (22, 28) to prevent said clamp mechanism (38) from entering the associated said open end (22, 28).

14. An assembly as set forth in claim 12 wherein each pair of said jaws (40) are curved to enhance clamping to said open ends (22, 28).

15. A method of rolling up a flexible panel (32) having edges about a pole having a first open end (22) presenting a first circular rim and a second open end (28) presenting a second circular rim, said method characterized by the steps of;

clamping an edge of a panel (32) of flexible material to the first rim at the first open end (22), clamping an opposite edge of the panel (32) to the second rim at the second open end (28) in a second clamping position, rotating the pole to coil the panel (32) about the pole, storing a first clamp mechanism (38) in the first open end (22), moving the first clamp mechanism (38) to a first clamping position for clamping an edge of a panel (32) of flexible material to the first rim, and urging the clamp mechanism (38) into the first open end (22) while allowing the clamp mechanism (38) to move to the clamping position.

16. A method as set forth in claim 15 including storing a second clamp mechanism (38) in the second open end (28), and moving the second clamp mechanism (38) to a second clamping position for clamping the opposite edge of the panel (32) to the second rim.

17. A method as set forth in claim 15 including telescoping a first tubular member (20) having the first open end (22) into a second tubular member (26) having the second open end (28) and extending the tubular members (20, 26) to an extended position for clamping the opposite edges of a panel (32).

* * * * *